US011555301B2

(12) United States Patent
Wilcox

(10) Patent No.: US 11,555,301 B2
(45) Date of Patent: Jan. 17, 2023

(54) SHOWER HEAD SYSTEM

(71) Applicant: Isaac Wilcox, Berkeley, CA (US)

(72) Inventor: Isaac Wilcox, Berkeley, CA (US)

( * ) Notice: Subject to any disclaimer, the term of this patent is extended or adjusted under 35 U.S.C. 154(b) by 0 days.

(21) Appl. No.: 17/244,820

(22) Filed: Apr. 29, 2021

(65) Prior Publication Data

US 2021/0340745 A1 Nov. 4, 2021

Related U.S. Application Data

(60) Provisional application No. 63/101,405, filed on Apr. 29, 2020.

(51) Int. Cl.

| | |
|---|---|
| ***E03C 1/04*** | (2006.01) |
| ***B05B 1/16*** | (2006.01) |
| ***B05B 1/18*** | (2006.01) |

(52) U.S. Cl.

CPC ..... *E03C 1/0408* (2013.01); *B05B 1/1672* (2013.01); *B05B 1/18* (2013.01)

(58) Field of Classification Search

CPC ..... E03C 1/0408; B05B 1/1672; B05B 1/18

See application file for complete search history.

(56) References Cited

U.S. PATENT DOCUMENTS

| | | | | |
|---|---|---|---|---|
| 4,077,570 | A * | 3/1978 | Harmony | B05B 1/323 239/533.13 |
| 4,554,690 | A * | 11/1985 | Knapp | E03C 1/06 4/601 |
| 4,872,225 | A * | 10/1989 | Wagner | E03C 1/046 4/662 |
| 5,077,842 | A | 1/1992 | Home, Jr. | |
| 5,148,556 | A * | 9/1992 | Bottoms, Jr. | A47K 3/281 239/273 |
| 6,042,027 | A | 3/2000 | Sandvik | |
| 9,578,994 | B2 | 2/2017 | Capp et al. | |
| 2003/0062426 | A1* | 4/2003 | Gregory | B05B 1/323 239/533.13 |
| 2003/0226200 | A1 | 12/2003 | Charonis | |
| 2014/0008467 | A1* | 1/2014 | Allard | B05B 1/207 239/562 |
| 2015/0082535 | A1* | 3/2015 | Parks | E03C 1/0408 4/601 |
| 2019/0217314 | A1 | 7/2019 | Rexach et al. | |

* cited by examiner

*Primary Examiner* — Qingzhang Zhou
(74) *Attorney, Agent, or Firm* — My Patent Guys; Christopher Pilling; Johan Eide

(57) ABSTRACT

The present invention provides a shower head system for the preservation of a water supply of a shower. The user is allowed the option to configure the water supply in a secondary outlet flow and a primary outlet flow. The secondary outlet flow, in some embodiments, is a droplet or rain-style flow. Without impeding the traditional or existing shower head the current invention allows the user to conserve water and customize different bathing experiences while doing so.

7 Claims, 9 Drawing Sheets

SHOWER HEAD SYSTEM

RELATED APPLICATION

This application claims priority to provisional patent application U.S. Ser. No. 63/101,405 filed on Apr. 29, 2020, the entire contents of which is herein incorporated by reference.

BACKGROUND

1. Field of the Invention

The present invention relates to a modular shower head.

2. Description of Related Art

Traditionally shower heads spray water through orifices or openings from a cavity directing the spread and flow of the water. Some shower heads spray over a larger area by widening the cavity in the shower head. Water coverage and flow volume from the shower is limited by the dimensions of the cavity in the shower head and the flow rate of a water supply up to and through the cavity. Commonly, the user has to choose between a large area coverage or low area coverage shower head to be permanently engaged with the water supply. Different coverage and flow rates of shower water may be desired by the user for different shower experiences. With water conservation becoming an increasing issue of concern higher area coverage shower heads are becoming impractical and restricted due to excessive water use. A better system is needed for allowing a user to customize the area coverage and flow rate of a high area coverage shower to run in conjunction with or independently from a traditional shower feature while maintaining water conservation standards.

SUMMARY

The present invention provides a shower head system for the preservation of a water supply of a shower. The user is allowed the option to configure the water supply in a secondary outlet flow and a primary outlet flow. The secondary outlet flow, in some embodiments, is a droplet or rain-style flow. Without impeding the traditional or existing shower head the current invention allows the user to conserve water and customize different bathing experiences while doing so.

An object of the present invention is to lower water use when compared with other shower heads designed for high area coverage.

Another object of the present invention is to provide a configurable secondary outlet flow that is customizable with interchangeable emitters to meet the water coverage and flow needs of the user and improve ease of maintenance or replacement of clogged or malfunctioning emitters.

In order to do so, a shower head system for use within a shower is presented. The shower head system having a valve is adjoined to a water supply and is in fluid connection with the water supply, a shower head, and a conduit array. Along with the conduit array, at least one pressure compensating emitter is removably adjoined. The at least one pressure compensating emitter outputs a constant flow rate of the water supply independent of the supply pressure of the water supply. In doing so, the user can configure and regulate a secondary outlet flow of the shower head system in a downward direction in conjunction with or independent of the primary outlet flow of the shower head.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

DETAILED DESCRIPTION OF CERTAIN EMBODIMENTS

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

Figure 1:
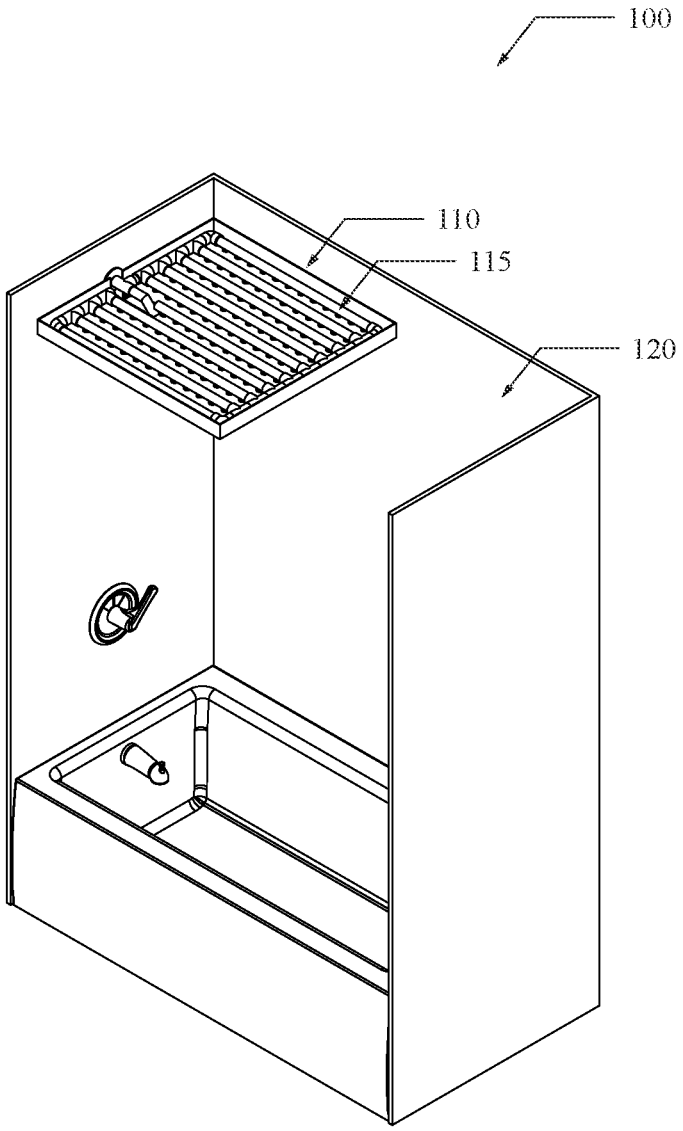
FIG. 1 shows an exemplary perspective view of one embodiment of the modular shower head within an exemplary shower.
Figure 2:
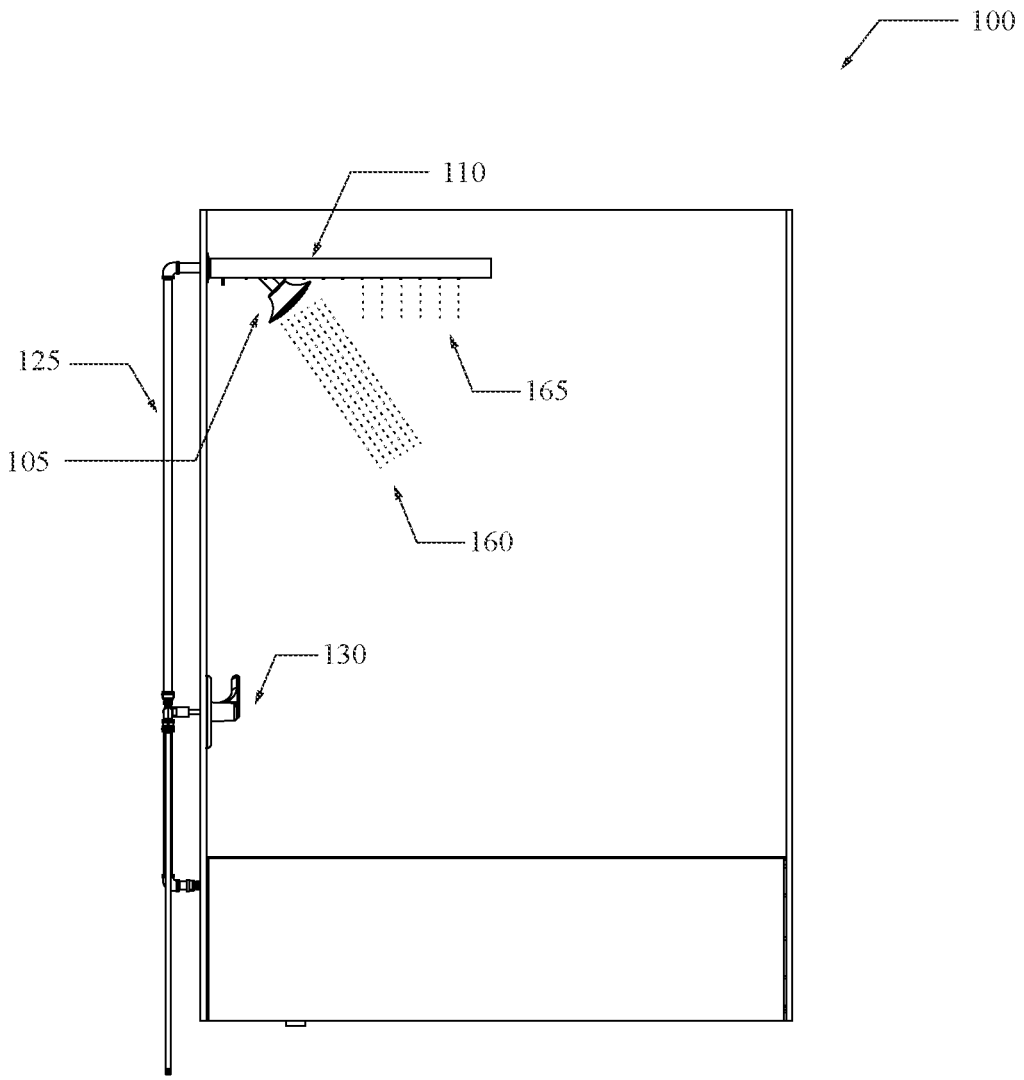
FIG. 2 shows an exemplary side view of one embodiment of the modular shower head within an exemplary shower.
Figure 3:
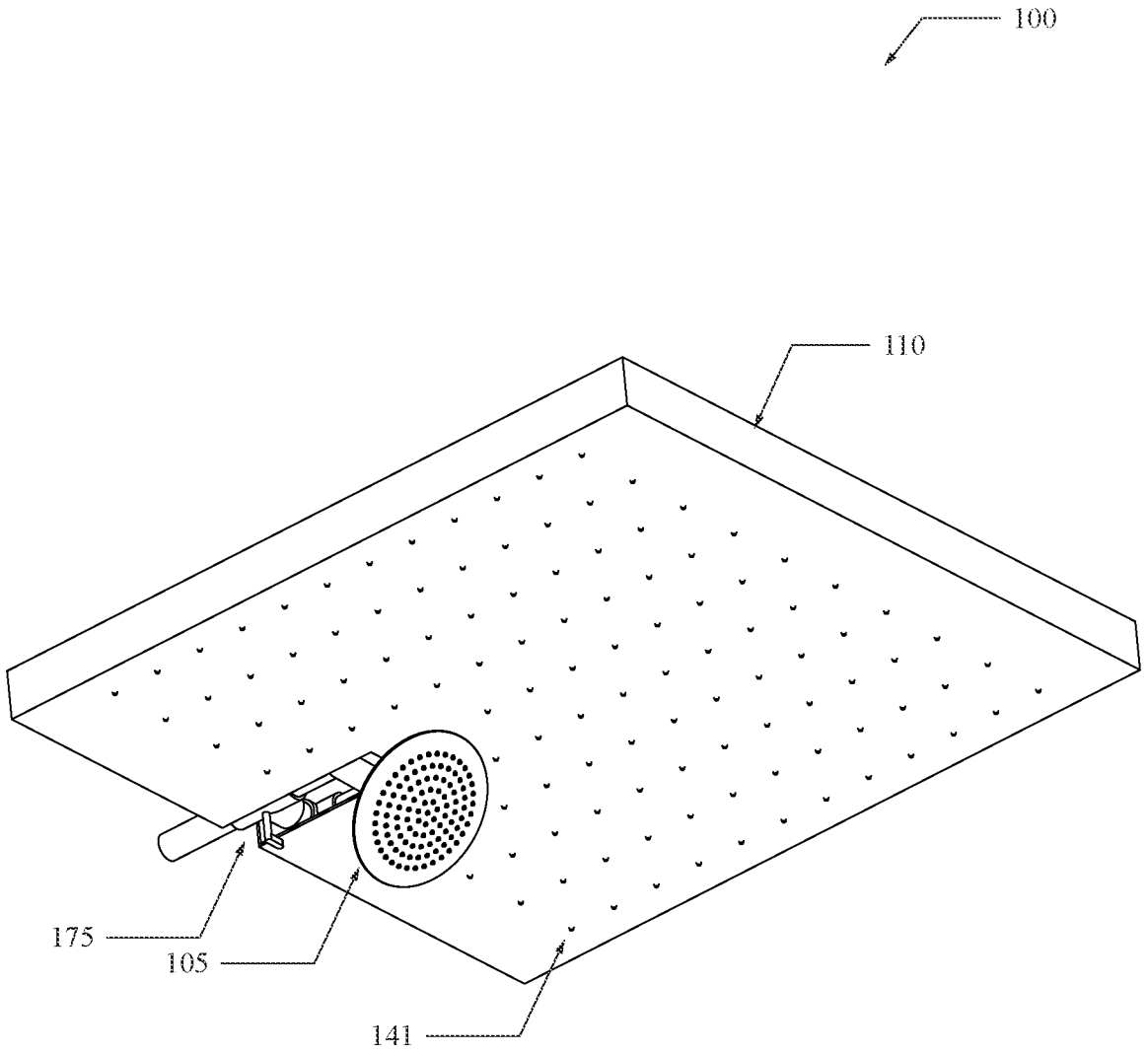
FIG. 3 shows an exemplary perspective view of one embodiment of the modular shower head.
Figure 4:
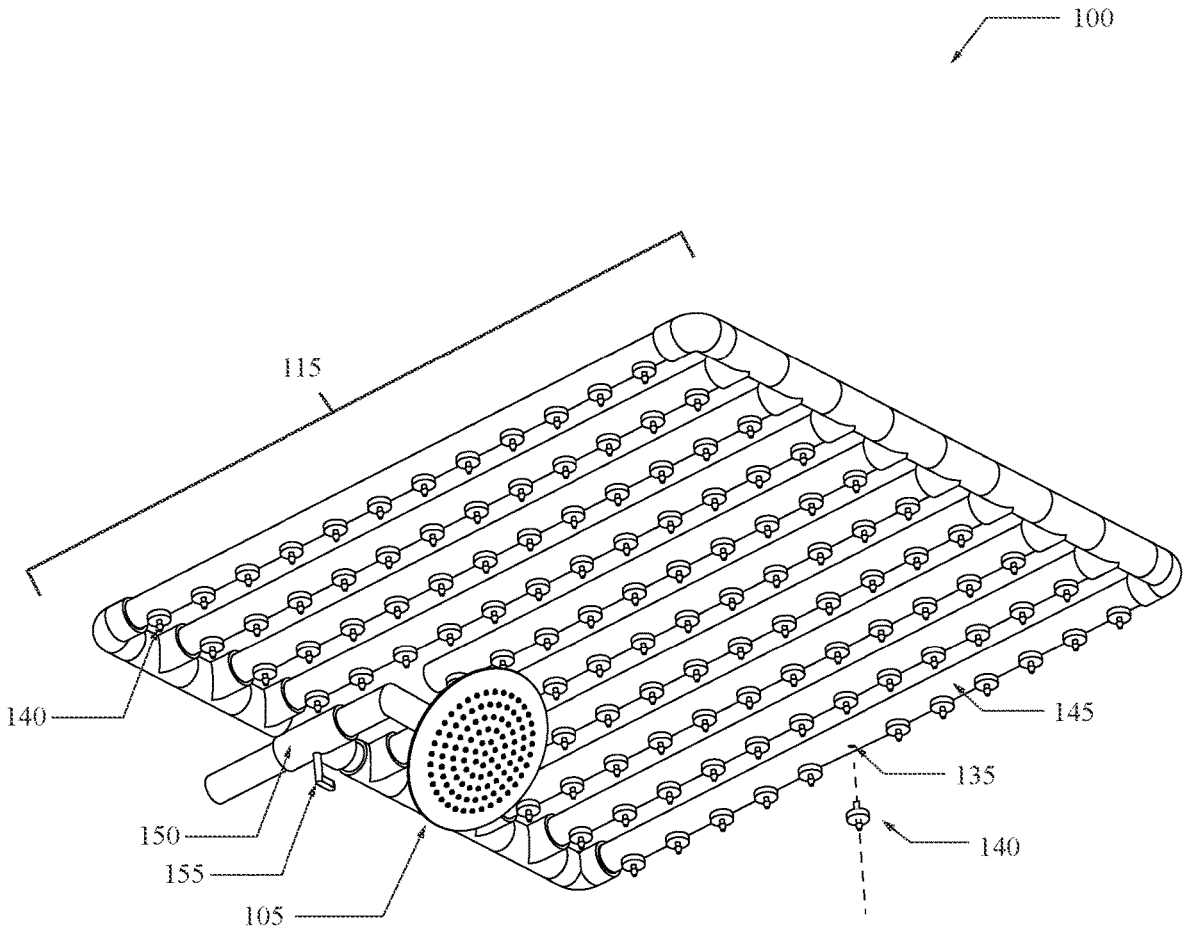
FIG. 4 shows an exemplary perspective view of one embodiment of the modular shower head.

As shown in FIGS. 1, 2, 3, and 4 a shower head system 100 for use within a shower is presented. In the exemplary embodiment illustrated, the shower head system 100 is positioned along a primary plane 170 in relation to a water supply 125. The shower head system 100 is connected to a water supply 125 having a supply pressure. As shown in FIG. 2, commonly available commercial embodiments of the shower 120 will have a mixing valve 130 wherein different water supplies of different temperatures may be mixed selectively by the user prior to entering the shower head system 100. A valve 150 having an input device 155 is adjoined to the water supply 125 and is in fluid connection with the water supply 125, the shower head 105, and a conduit array 115. In some embodiments, the conduit array 115 is replaced with a single cavity having an internal volume, not illustrated. The water supply 125 is connected to an inlet of the valve 150 and on an opposing outlets of the valve 150 a shower head 105 and the conduit array 115 are connected. The conduit array having a plurality of conduits 145.

Along the plurality of conduits 145 of the conduit array 115, at least one pressure compensating emitter 140 is removably adjoined to the plurality of conduits 145 within a first opening 135. The at least one pressure compensating emitter 140 emitting a constant flow rate of the water supply 125 independent of the supply pressure of the water supply 125. In doing so, the user can configure and regulate a secondary outlet flow 165 of the shower head system 100 in a downward direction in conjunction with or independent of the primary outlet flow 160 of the shower head 105. In some embodiments, the secondary outlet flow 165 may have droplets varying in size depending on the size and type of at least one pressure compensating emitter 140 chosen by the user. Different embodiments of the shower head system 100 may have at least one pressure compensating emitter 140 of different coefficients of variation, herein defined as cv, to improve a uniformity of the system. In some embodiments, the secondary outlet flow 165 is configured to simulate droplets or rain felt by the user of the shower head system 100.

Figure 5:
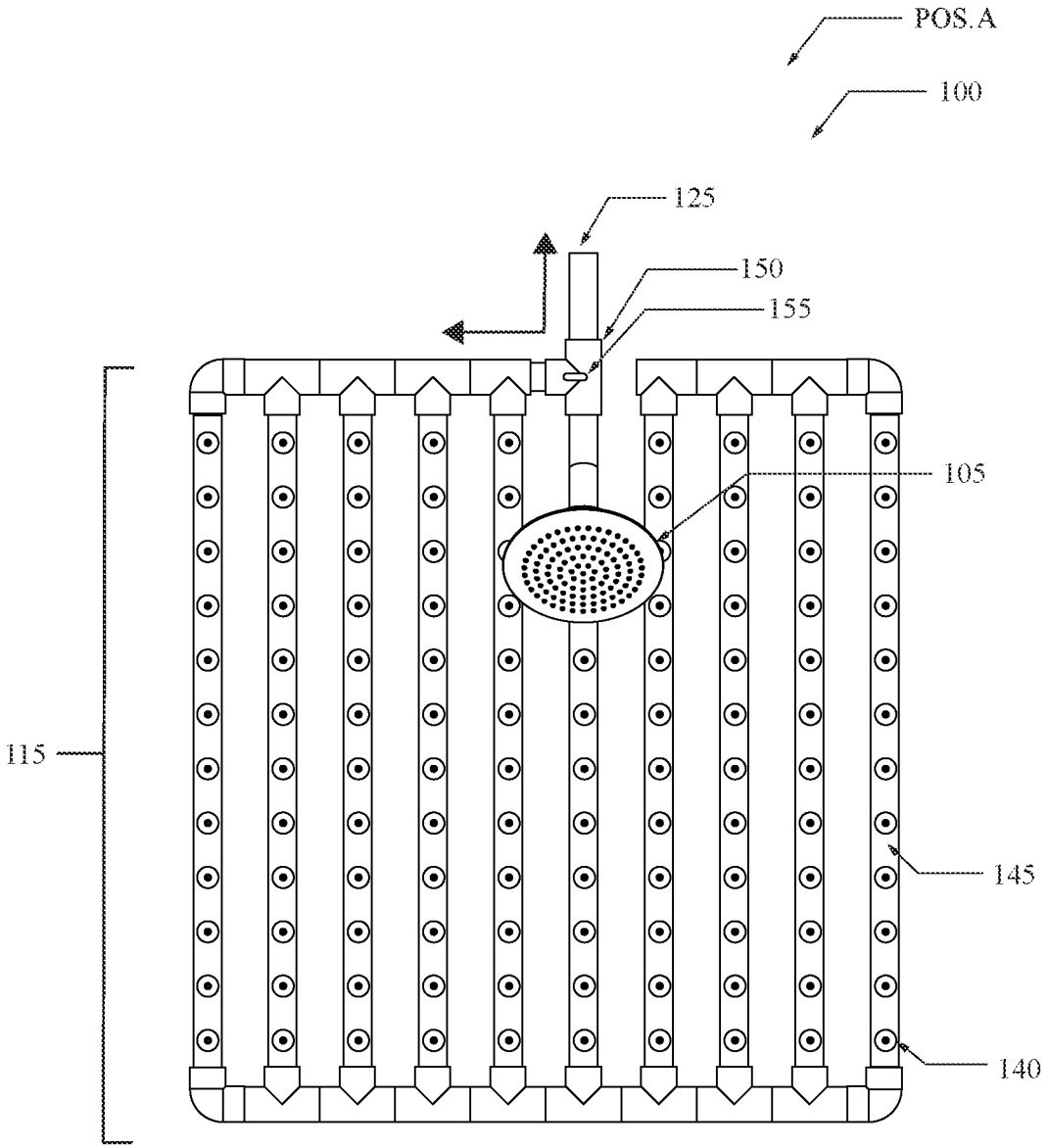
FIG. 5 shows an exemplary bottom view of one embodiment of the modular shower head.
Figure 6:
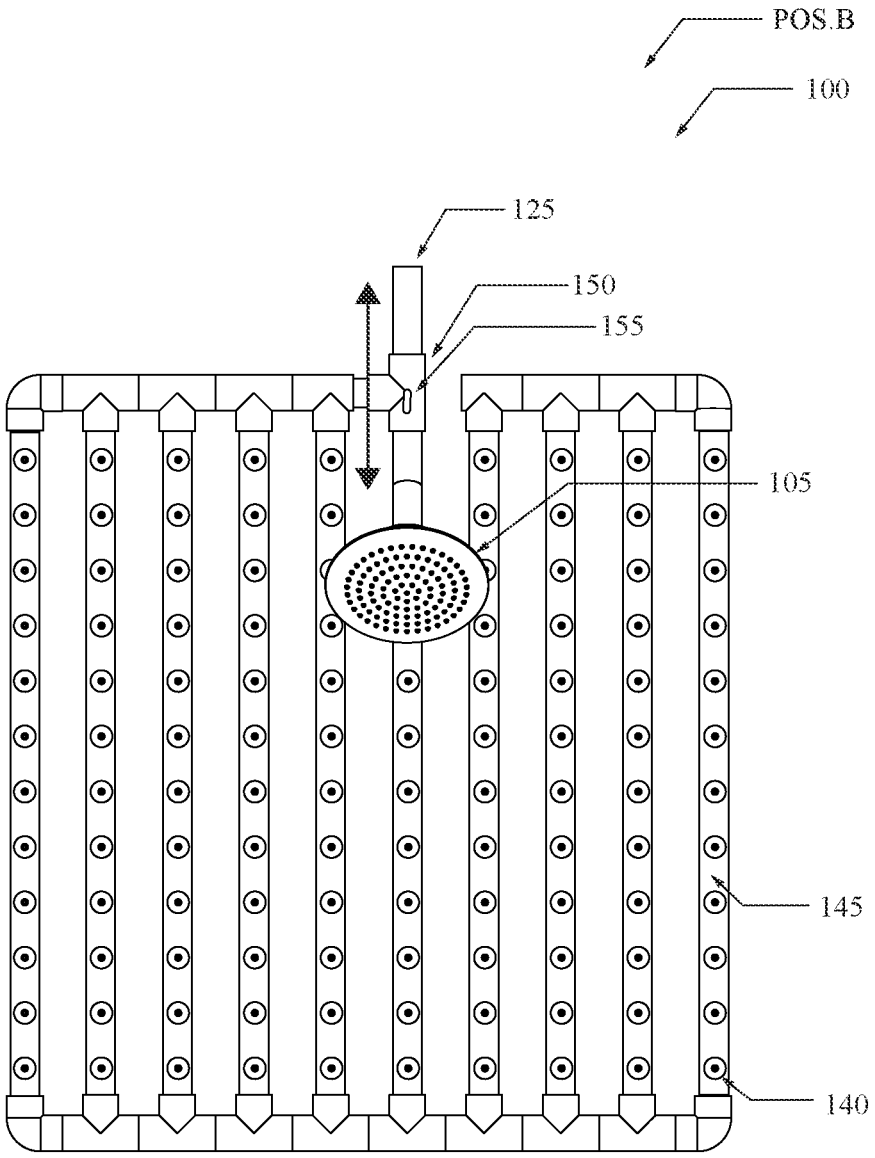
FIG. 6 shows an exemplary bottom view of one embodiment of the modular shower head.

As shown in FIGS. 5 and 6, selectively the user may engage with the input device 155 of the valve 150. In a first mode of operation, a user may engage the valve 150 to direct the water supply 125 to a primary outlet flow 160 out of the shower head 105 (POS.B), as shown in FIG. 5. In a second mode of operation, the user may engage the valve 150 to (POS.A) direct the water supply 125 to the conduit array 115 out of the at least one pressure compensating emitter 140 as the secondary outlet flow out 165.

The at least one pressure compensating emitter 140 has the ability to regulate flow rates despite variations in supply pressures of the water supply 125. The pressure-compensating component of the emitter 140 commonly may involve the use of an elastic diaphragm that enlarges or contracts an orifice open area in relation to supply pressure to provide a more consistent flow rate of the secondary outlet flow 165 of the shower head system 100.

In some embodiments, the at least one pressure compensating emitter 145 has a threshold pressure or a minimum compensating inlet pressure, herein defined as a MCIP. In exemplary operation, the supply pressure of the water supply 125 must be equal to or above the threshold pressure in order for the at least one pressure compensating emitter 140 to emit the secondary outlet flow 165. In some embodiments, the secondary outlet flow is non-continuous and intermittent based on the at least one pressure compensating emitter 140 selected by the user. In some embodiments, the at least one pressure compensating emitter 140 is at least one member of an emitter set comprising: adjustable flow emitter, diaphragm emitters, vortex emitters tortuous-path or turbulent-flow emitters short-path emitters, soaker hose, porous pipe, laser tubing, long-path emitters mechanical emitter, dripline, drip tape or any other pressure compensating emitter type known to one skilled in the art. In some embodiments, the shower head 105 additionally has at least one pressure compensating emitter 140. In some embodiments, the flow rate of at least one pressure compensating emitter 140 within the conduit array is a different flow rate than the at least one pressure compensating emitter 140 within the shower head 105. In other embodiments. The shower head 105 comprises a portion of the conduit array 115 and in aligned along the primary plane 170. For example, the shower head 105 may be a secondary conduit array within a portion of the conduit array 115 having different flow rates.

Figure 7:
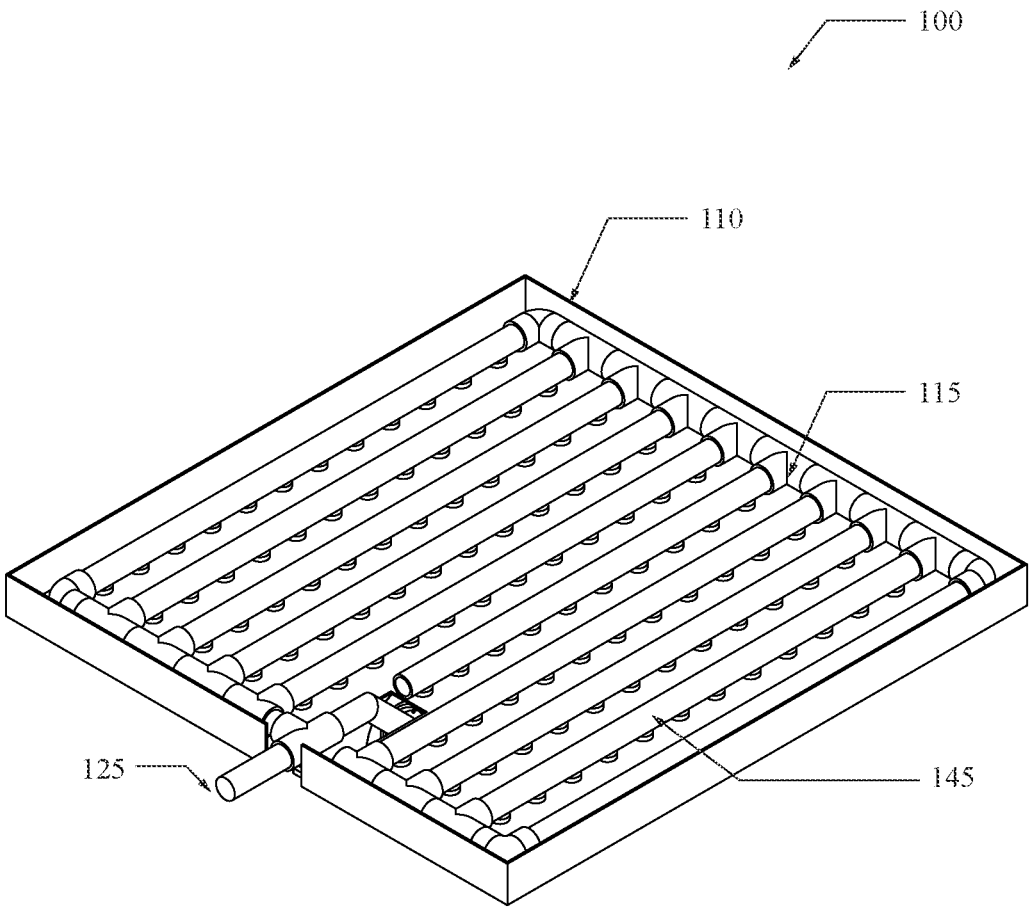
FIG. 7 shows an exemplary perspective view of one embodiment of the modular shower head.
Figure 8:
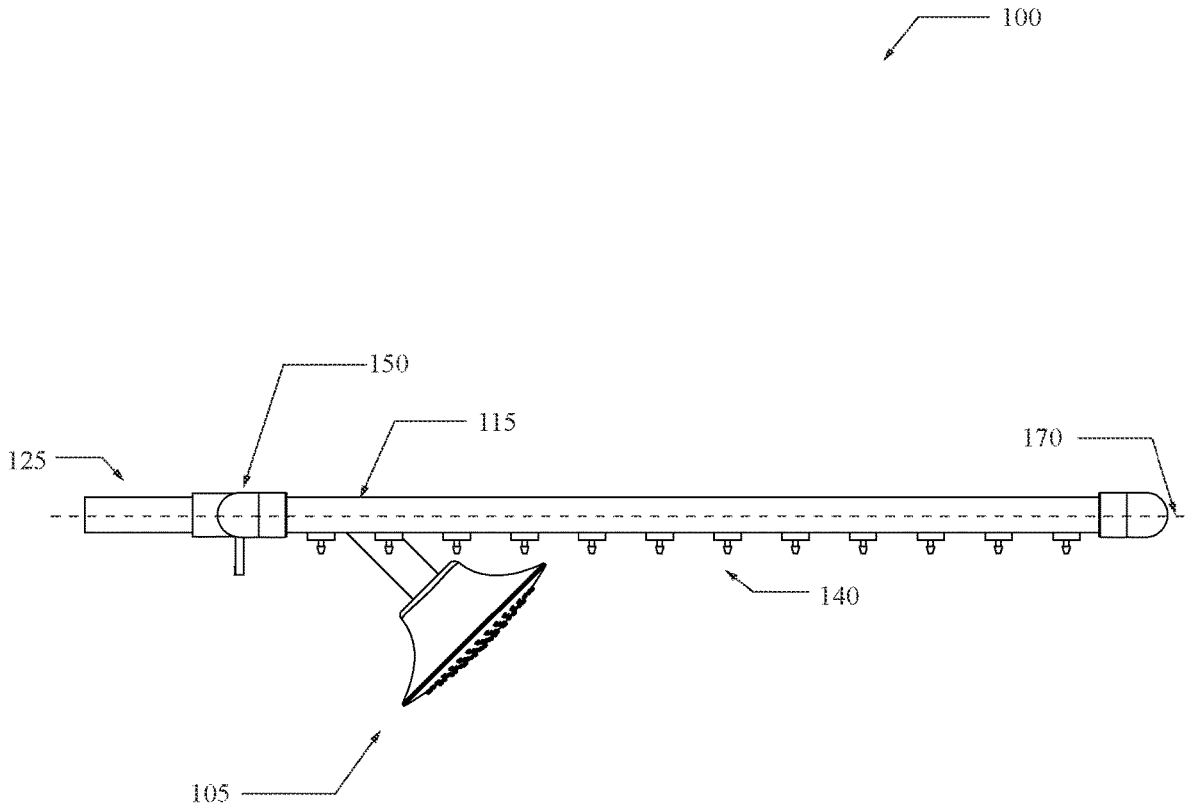
FIG. 8 shows an exemplary side view of one embodiment of the modular shower head.
Figure 9:
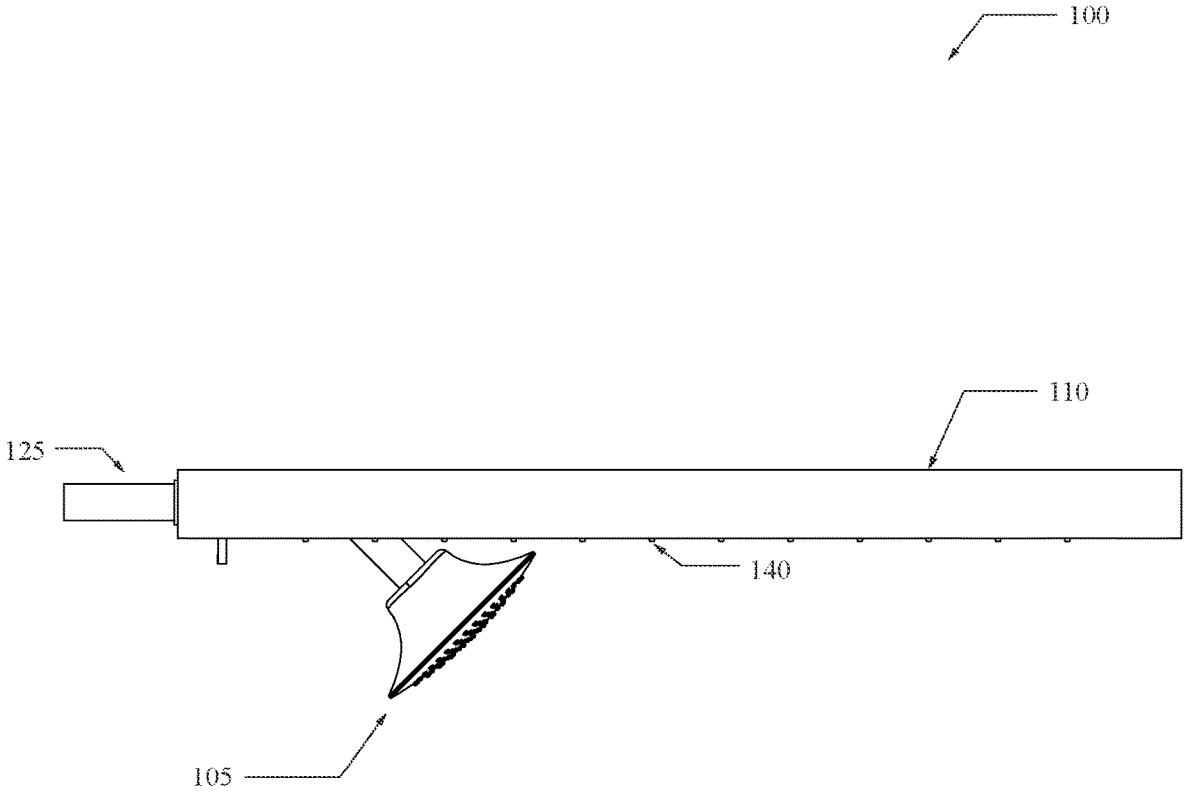
FIG. 9 shows an exemplary side view of one embodiment of the modular shower head.

As shown in FIGS. 7, 8, and 9 the shower head system 100 may comprise a cover 110 substantially sized and shaped to cover the conduit array 115. In the current embodiment, the cover 110 is a hollow rectangular shape open on one side to hold the conduit array 115 within. In some embodiments, the cover 110 is adjoined to a surface of a shower 120. In other embodiments, the conduit array 115 is adjoined to a surface of the shower 120. In some embodiments, the conduit array 115 and/or the cover 110 may be circular or any other shape desired by the user. As best illustrated in FIG. 9, in some embodiments a portion of the at least one pressure compensating emitter 140 protrudes through the cover 110, covering a majority of the conduit array 115 from being visible to the user. The cover 110 may also comprise a cut out 175 sized and shaped to allow at least one of the shower head 105, the valve 150, the input device 155, or the water supply 125 to protrude through the cover 110.

In some embodiments, the valve of the shower head system 100 comprises at least one member of a valve set consisting of: a pressure control valve, a flow control valve, a directional control valve, a directly operated valve, a pilot operated valve, a manually operated valve, an electrically actuated valve, an open control valve, a servo-controlled valve, or a manifold.

In some embodiments, the shower head system 100 is in a modular configuration, the shower head system 100 may be housed within a cover 110 removably joined to a wall, a pipe, surface of the shower 120, a building, or a structure. In other embodiments, are configured in a permanent configuration, the shower head system 100 may also include the cover 110 permanently attached to a wall, a pipe, surface of the shower 120, a building, or a structure.

In some embodiments, the shower head system 100 may be comprised of standard piping and conduit that is commercially available, such as ½"-1" PVC conduit. It should be understood that the size and material of the conduits may vary without departing from the spirit and scope of the invention. It should also be understood, that the embodiment described above is for retrofitting existing plumping assemblies. In other assemblies, the shower head system 100 can be configured differently during new construction processes.

Components and the conduit of the shower head system 100 may be assembled via an attachment set consisting of: a weld, at least one fastener, an adhesive, at least one threaded surface, a chemical bonding process, a press-fit, a clamp, a spring, and other attachment sets known in the art.

In some embodiments, the shower head system 100 is made of at least one material of a material set, by way of non-limiting example consisting of: a metal material, a composite material, a ceramic material, a cast iron material, a stainless steel material, a fiberglass material, a carbon fiber material, and a plastic material. Each point of connection of the shower head system 100 may further include at least one seal. Wherein the at least one seal is constructed from a seal material set consisting of: a rubber material, a composite material, a rubber material, a non-rigid material, a foam material, a cork material, a silicone material, a fabric material, a neoprene material, a polytetrafluoroethylene material, and a plastic polymer material.

In some embodiments, the shower head system 100 may require external texture to grip the hand of the user. In exemplary embodiments, the external texture further comprises at least one member of a texture set consisting of:

indentations, sandpaper, extrusions, knurling, a rough surface, bumps, or any combination thereof.

In other embodiments, a further aide may be needed by the user to correlate the alignment and matching of the shower head system, the shower head, or the water supply. In such embodiments, the shower head system 100 may comprise at least one member of an identification set consisting of: an alphanumeric identification, a human user's name, a symbolic shape, a company brand, a numeric identification number, a QR code, a barcode, and an RFID tag. For example, an arrow may depict the directional control of the valve 150 letting the user know if the primary outlet flow 160 or the secondary outlet flow 165 is selected.

In reference to FIGS. 1 through 9, the present invention may include the following elements:

a shower head system 100
a shower head 105
a cover 110
a conduit array 115
a shower 120
a water supply 125
a mixing valve 130
a first opening 135
an emitter 140
a cover opening 141
a conduit 145
a valve 150
an input device 155
a primary outlet flow 160
a secondary outlet flow 165
a primary plane 170
a cut out 175
a primary position POS.A
a secondary position POS.B As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shower head system for use within a shower, the shower head system comprising:
- a water supply having a supply pressure;
- a shower head;
- a conduit array having a plurality of conduits;
- at least one pressure compensating emitter adjoined to the plurality of conduits;
- a valve having an input device and in fluid connection with the water supply, the shower head and the conduit array, wherein the valve and the conduit array are positioned along a primary plane;
- wherein a first mode of operation a user may engage the valve to direct the water supply to a primary outlet flow out of the shower head; and
- wherein a second mode of operation the user may engage the valve to direct the water supply to a secondary outlet flow out of the at least one pressure compensating emitter, wherein the at least one pressure compensating emitter comprises an elastic diaphragm that enlarges and contracts an orifice open area in relation to the supply pressure to regulate a more consistent flow rate of the secondary outlet flow despite variations in the supply pressure.

2. The shower head system of claim 1, wherein the at least one pressure compensating emitter further comprises:
- a threshold pressure wherein the supply pressure must be equal to or above the threshold pressure in order to emit the secondary outlet flow at a consistent flow rate.

3. The shower head system of claim 1, further comprising:
- a cover substantially sized and shaped to cover the conduit array.

4. The shower head system of claim 3, wherein the cover is rectangular.

5. The shower head system of claim 1, wherein the conduit array is adjoined to a surface of the shower.

6. The shower head system of claim 1, wherein the at least one pressure compensating emitter is interchangeable.

7. A shower head system for use within a shower, the shower head system comprising:
- a water supply having a supply pressure;
- a shower head;
- a conduit array having a plurality of conduits;

a cover substantially sized and shaped to cover the conduit array;

at least one pressure compensating emitter adjoined to the plurality of conduits;

a valve having an input device and in fluid connection with the water supply, the shower head and the conduit array;

wherein a first mode of operation a user may engage the valve to direct the water supply to a primary outlet flow out of the shower head; and wherein a second mode of operation the user may engage the valve to direct the water supply to a secondary outlet flow out of the at least one pressure compensating emitter, wherein the at least one pressure compensating emitter comprises an elastic diaphragm that enlarges and contracts an orifice open area in relation to the supply pressure to regulate a more consistent flow rate of the secondary outlet flow despite variations in the supply pressure.

* * * * *